US005673500A

United States Patent [19]

Huang

[11] Patent Number: 5,673,500

[45] Date of Patent: Oct. 7, 1997

[54] SHOE WITH WEIGHING MEANS

[75] Inventor: Tien-Tsai Huang, Pan-chiao, Taiwan

[73] Assignee: Raymond Hwang, Chang Hua Hsien, Taiwan

[21] Appl. No.: 570,325

[22] Filed: Dec. 11, 1995

[51] Int. Cl.[6] ..... A43B 23/00; A43B 13/20

[52] U.S. Cl. ..... 36/136; 36/29; 73/172

[58] Field of Search ..... 36/29, 132, 136, 36/3 B; 128/779; 73/172, 714

[56] References Cited

U.S. PATENT DOCUMENTS

| | | | |
|---|---|---|---|
| 3,044,190 | 7/1962 | Urbany | 36/29 |
| 3,791,375 | 2/1974 | Pfeiffer . | |
| 3,876,746 | 4/1975 | Hanson | 36/117.6 |
| 3,974,491 | 8/1976 | Sipe | 36/137 X |
| 4,446,634 | 5/1984 | Johnson et al. | 36/29 |
| 4,610,099 | 9/1986 | Signori | 36/29 |
| 5,092,415 | 3/1992 | Asano . | |
| 5,113,599 | 5/1992 | Cohen et al. | 36/29 X |
| 5,129,472 | 7/1992 | Du et al. . | |
| 5,199,191 | 4/1993 | Moumdjian | 36/29 X |
| 5,230,249 | 7/1993 | Sasaki et al. | 73/172 |
| 5,295,314 | 3/1994 | Moumdijan | 36/29 |
| 5,313,717 | 5/1994 | Allen et al. | 36/29 X |

*Primary Examiner*—Ted Kavanaugh
*Attorney, Agent, or Firm*—Fish & Richardson P.C.

[57] ABSTRACT

A shoe including a shoe body having an outsole defining a receiving chamber, and an upper fastened to the outsole; an insole formed as an air bag filled with air; and a pressure gauge mounted on and exposed from the upper of the shoe body and connected to the insole to measure the pressure applied to the insole.

8 Claims, 2 Drawing Sheets

SHOE WITH WEIGHING MEANS

FIELD OF THE INVENTION

The present invention relates to shoes, particularly to such a shoe which can measure the weight of the user.

BACKGROUND OF THE INVENTION

A variety of shoes have been disclosed for use in different conditions, and have appeared on the market. In order to provide comfort to the user or to attract consumers' attention, a shoe may be equipped with an air bag, a light producing means, a compass, etc. Furthermore, one's weight is of great concern to many people. In order to control cone's weight, some people measure their weight daily. However, most weighing scales, including the so-called handy weighing scales, are not conveniently carried.

SUMMARY OF THE INVENTION

The present invention provides a shoe which can be used as a weighing instrument for measuring the user's weight. According to one aspect of the present invention, the shoe comprises a shoe body having an outsole defining a flat receiving chamber, and an upper fastened to the outsole; an insole made from an air bag filled up with air; and a pressure gauge mounted on the upper of the shoe body on the outside and connected to the insole by an air tube to measure the weight borne by the insole. When the user steps on the insole, the insole compresses, and the pressure gauge is activated to move the index to the reading corresponding to the weight of the user. According to another aspect of the present invention, the air tube is connected to an air hole on the insole by a connector. The air hole is sealed by a diaphragm before the installation of the connector. The connector has a pointed projection at one end, and a longitudinal center hole. When the connector is installed, the pointed projection pierces the diaphragm affixed to the air hole of the insole, permitting the air to flow from the insole through the longitudinal center hole of the connector into the air tube and the pressure gauge. According to still another aspect of the present invention, the air bag of the insole comprises a front air chamber, a rear air chamber, and an intermediate air chamber communicating between the front air chamber and the rear air chamber. Therefore, the user feels comfortable when walking. If the pair of shoes are each mounted with a weighing means to measure the weight of the user, the readings of the pressure gauges of the two shoes must be calculated together.

DETAILED DESCRIPTION OF THE PREFERRED EMBODIMENT

Figure 1:
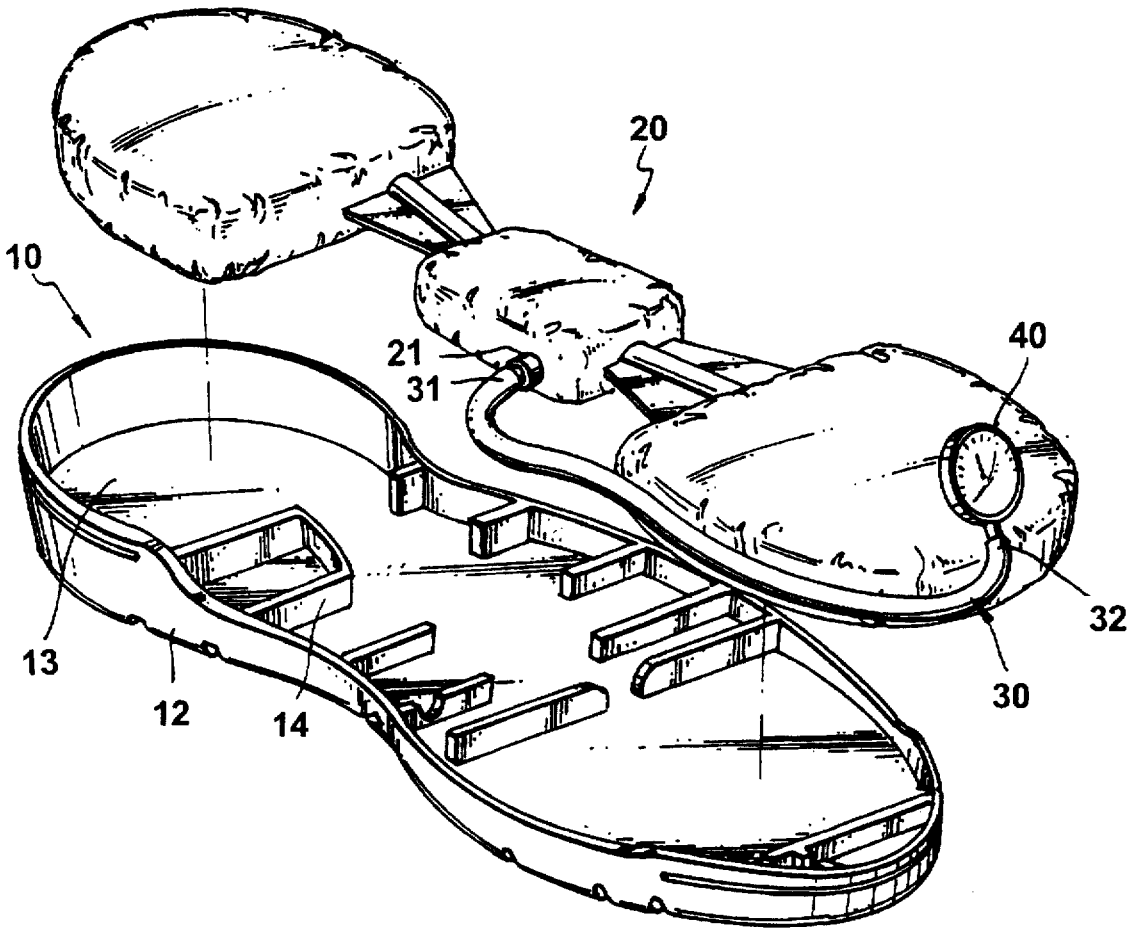
FIG. 1 shows the internal structure of a shoe according to an embodiment of the present invention.
Figure 2:
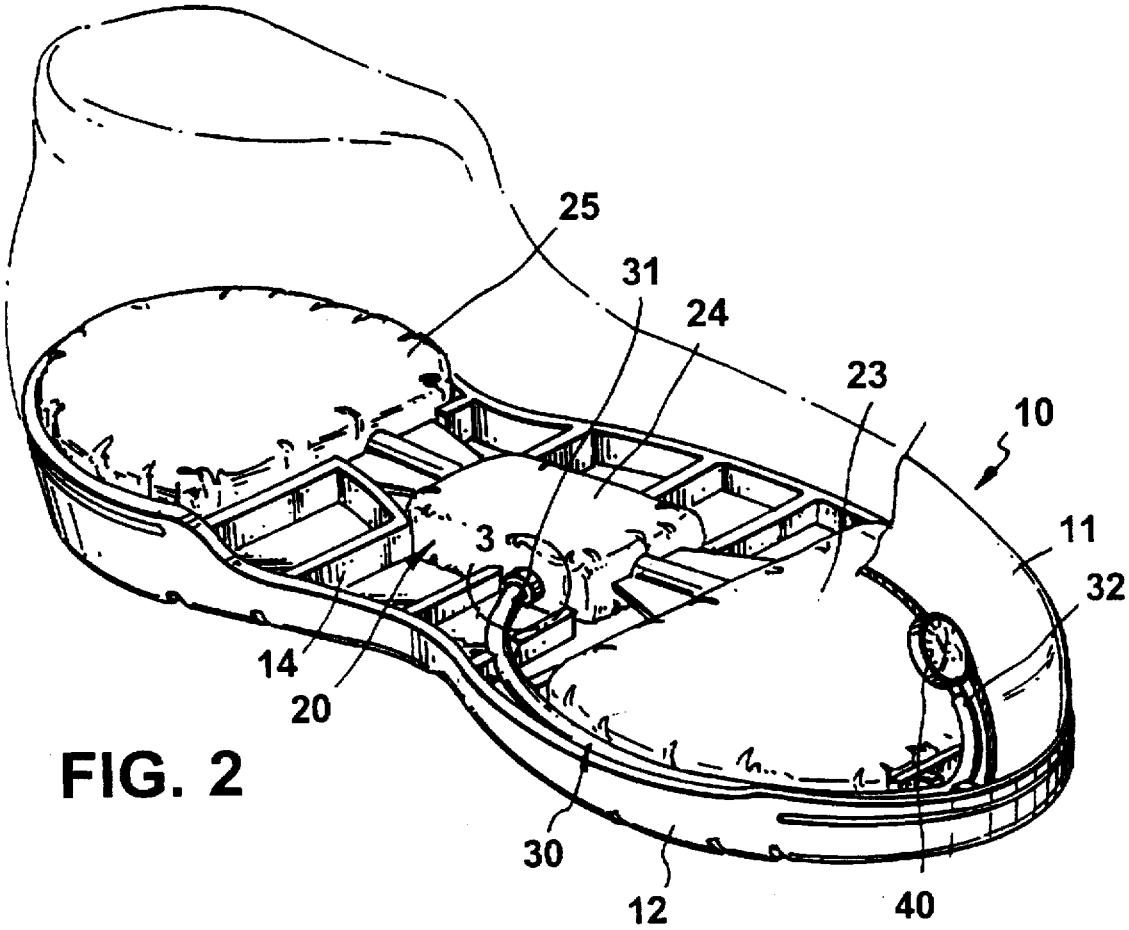
FIG. 2 is a broken perspective view of the shoe according to an embodiment of the present invention.

Referring to FIGS. 1 and 2, a shoe in accordance with the present invention is generally comprised of a shoe body 10, an insole 20, an air tube 30, and a pressure gauge 40. The shoe body 10 comprises an upper 11 and an outsole 12. The outsole 12 defines a receiving chamber 13 for holding the insole 20. The pressure gauge 40 is mounted on the upper 11 near the front side of the shoe. The insole 20 is a hollow, soft structure filled with air and is mounted within the receiving chamber 13 of the outsole 12, and has an air hole 21 connected to the pressure gauge 40 through the air tube 30. The air tube 30 has a first end 31 connected to the air hole 21 of the insole 20, and a second end 32 connected to the pressure gauge 40.

Figure 3:
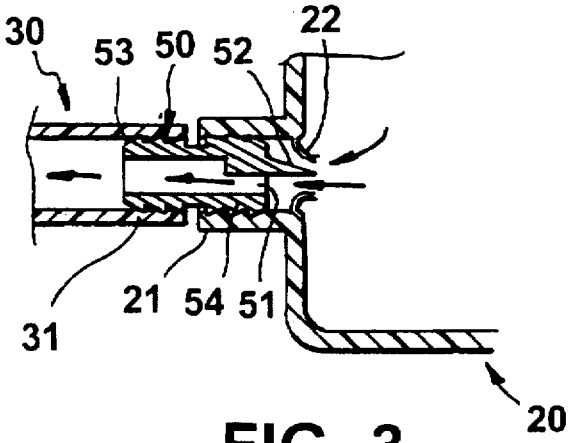
FIG. 3 is a sectional view showing the connection between the inflatable insole and the air tube according to an embodiment of the present invention.

Referring to FIG. 3 and FIG. 2, the first end 31 of the air tube 30 is connected to the air hole 21 of the insole 20 by a connector 50. The connector 50 comprises a first toothed portion 53 and a second toothed portion 54, each toothed portion formed around the periphery of connector 50 and tapering toward its respective end, a longitudinal air passage 51 through the length of the connector 50, and a pointed projection 52 axially projected from one end of the connector 50. The air hole 21 of the insole 20 is sealed by a diaphragm 22 to prohibit leakage of air. During the assembly process, the first toothed portion 53 of the connector 50 is fastened to the inner diameter of the air tube 30, then the second toothed portion 54 of the connector 50 is fastened to the air hole 21 of the insole 20. When the connector 50 is installed, the pointed projection 52 pierces the diaphragm 22, permitting air to escape from the insole 20 through the connector 50 and the air tube 30 to the pressure gauge 40. Before the installation of the connector 50, adhesive may be applied to the first toothed portion 53 and the second toothed portion 54 so that the connector 50 can be fixedly secured to the air tube 30 and the air hole 21 of the insole 20 to prevent leakage of air. When the user steps on the insole 20, the pointer of the pressure gauge 40 is turned to the reading corresponding to the weight of the user.

Referring to FIG. 2 again, the insole 20 is comprised of a front air chamber 23, an intermediate air chamber 24, and a rear air chamber 25, which communicate with each other through a tube-like channel. When walking or running, the air is forced to move between the air chambers 23, 24, and 25 to buffer the pressure given by the user, and therefore the user feels comfortable when walking or running.

The insole 20 may be secured by an anchoring means 14 fixed on the receiving chamber 13. The anchoring means 14 may include partition ribs which are separately spaced from one another and formed integral with the outsole 12.

It is to be understood that the drawings are designed for purposes of illustration only, and are not intended to define the limits and scope of the invention disclosed.

I claim:

1. A shoe comprising:

a shoe body having an outsole defining a receiving chamber, and an upper fastened to said outsole, said upper configured to mountingly receive a pressure gauge on said upper;

an insole including a front air chamber, an intermediate air chamber, and a rear air chamber, each formed as an air bag filled with air, wherein said air chambers are spaced longitudinally from each other in said receiving chamber, and are in communication with each other, said intermediate chamber having an air hole sealed by a diaphragm;

a plurality of partition ribs, each rib spaced from another of the ribs and provided within said receiving chamber to anchor said air chambers in said receiving chamber;

an air tube having a first end connected to the air hole and a second end connected to said pressure gauge;

a connector including:

a first toothed portion and a second toothed portion to connect to said air tube and said air hole, respectively, each toothed portion formed around the periphery of said connector, a longitudinal air passage extending through the length of said connector, and a pointed projection configured to pierce said diaphragm which seals said air hole of said insole when said connector is connected between said air tube and said air hole to permit air to flow from said insole through the longitudinal air passage of said connector to said pressure gauge.

2. The shoe of claim 1, wherein said plurality of partition ribs are formed integral with said outsole.

3. The shoe of claim 1, wherein said air chambers in said receiving chamber communicate with each other through a tube-like channel.

4. The shoe of claim 1, wherein said first toothed portion and said second toothed portion taper toward their respective ends of said connector.

5. The shoe of claim 1, wherein said outsole has a bottom walking surface and a depressed top surface surrounded by an upstanding peripheral sidewall having an upper peripheral edge, said upstanding peripheral sidewall and said depressed top surface of said outsole together defining said receiving chamber lying generally below said upper peripheral edge.

6. The shoe of claim 5, wherein said plurality of partition ribs extends across said depressed top surface from said upstanding peripheral sidewall.

7. The shoe of claim 1, wherein at least one of said plurality of partition ribs is elongated.

8. The shoe of claim 1, wherein at least one of said plurality of partition ribs is configured to support said air tube within said receiving chamber.

* * * * *